US006968653B2

(12) United States Patent
Stapleton, Jr. et al.

(10) Patent No.: US 6,968,653 B2
(45) Date of Patent: Nov. 29, 2005

(54) FOLDING MODULAR STRUCTURE

(75) Inventors: James Alford Stapleton, Jr., Cornelia, GA (US); William Allen Canfield, Demorest, GA (US)

(73) Assignees: Habersham Metal Products Company, Cornelia, GA (US); Steel Cell of North America, Inc., Cornelia, GA (US)

( * ) Notice: Subject to any disclaimer, the term of this patent is extended or adjusted under 35 U.S.C. 154(b) by 80 days.

(21) Appl. No.: 10/675,665

(22) Filed: Sep. 30, 2003

(65) Prior Publication Data

US 2005/0066588 A1 Mar. 31, 2005

(51) Int. Cl.[7] ..... E04B 1/344
(52) U.S. Cl. ..... 52/79.1; 52/79.5; 52/79.9; 52/69
(58) Field of Search ..... 52/79.1, 79.5, 52/79.9, 69, 66, 68; 296/173, 163

(56) References Cited

U.S. PATENT DOCUMENTS 414,976 A * 11/1889 Harvey ..... 52/69
1,101,019 A * 6/1914 Finkelstein ..... 217/15
4,027,912 A * 6/1977 Pacca ..... 296/160
4,166,343 A * 9/1979 O'Brian et al. ..... 52/66
4,742,653 A * 5/1988 Napier et al. ..... 52/66
5,493,818 A * 2/1996 Wilson ..... 52/71
5,916,096 A * 6/1999 Wiesmann et al. ..... 52/63
6,415,558 B1 * 7/2002 Cherry ..... 52/79.1
6,434,895 B1 * 8/2002 Hosterman et al. ..... 52/143
6,557,308 B1 * 5/2003 Snel ..... 52/79.4

* cited by examiner

*Primary Examiner*—Basil Katcheves
(74) *Attorney, Agent, or Firm*—Greg O'Bradovich, P.C.

(57) ABSTRACT

A folding modular structure is described. The structure typically includes a top panel, which is ultimately the roof deck. Two side panels, a front and a rear panel are connected to the top panel by pivoting mechanisms so that the side, front and rear panels can fold open to create the modular structure. Spacer panels are connected between three of the four total side, front and rear panels. The spacer panels are necessary to provide clearance so that each of the panels can be folded onto the other already folded panels. In the folded configuration, shipping many more modular structures to final destinations is possible.

7 Claims, 7 Drawing Sheets

100
75
102
105
101
103
125
115
110
104
120
A

FOLDING MODULAR STRUCTURE

BACKGROUND

I. Field of the Invention

The present invention relates generally to the field of buildings and structures and, more particularly, to a folding modular structure.

II. Description of the Related Art

Modular structures have a variety of used in many industries. For example, remote sensing stations for meteorological towers or cellular towers require structures to house equipment and allow operators shelter. The military also uses structures for communications stations and the like. Another use of modular structures is for detention centers. Often times, jails and detention centers are created by stacking several individual prefabricated cells side by side and on top of one another to form a detention center. As stated these modular cells are prefabricated and often include all four walls and a floor. The cells can further include necessary reinforcements and hardware necessary for a detention cell. These cells are prefabricated at a suitable facility and then transported, typically by flatbed truck to their final destinations, which could include ships for overseas transport.

FIG. 1A illustrates a prior art flat bed transport truck 10 having a flat bed trailer 15 transporting prior art modular structures 20. The structures 20 are shown face to face or rear to rear displaying the side walls on the sides of the trailer 15. Typically, only three or four of the structures, which can weigh anywhere up to 30,000 pounds, can be placed on the trailer 15. It is typically time consuming and very expensive to be able to only ship three of four of the cells at a time.

SUMMARY

In general, the invention features a folding modular structure. The structure typically includes a top panel, which is ultimately the roof deck. Two side panels, a front and a rear panel are connected to the top panel by pivoting mechanisms so that the side, front and rear panels can fold open to create the modular structure. Spacer panels are connected between three of the four total side, front and rear panels. The spacer panels are necessary to provide clearance so that each of the panels can be folded onto the other already folded panels. In the folded configuration, shipping many more modular structures to final destinations is possible.

In general, in one aspect, the invention features a modular structure, including a top panel having four sides, a first spacer panel connected generally perpendicular to a first side of the top panel, a first panel pivotally connected to the first spacer panel, a second spacer panel connected generally perpendicular to a second side of the top panel, a second panel pivotally connected to the second spacer panel, a third spacer panel connected generally perpendicular to a third side of the top panel, a third panel pivotally connected to the third spacer panel and a fourth panel pivotally connected to a fourth side of the top panel.

In one implementation, the third spacer panel is wider than the second spacer panel and the second spacer panel is wider than the first spacer panel.

In another implementation, the width of the third spacer panel is generally equal to the sum of the thicknesses of the first, second and fourth panels.

In another implementation, the first spacer panel and the first panel are coplanar, the second spacer panel and second panel are coplanar and the third spacer panel and the third panel are coplanar.

In another implementation, two of the first, second, third and fourth panels are side walls of the structure, one of the first, second, third and fourth panels is the front wall of the structure and one of the first, second, third and fourth panels is the rear wall of the structure.

In still another implementation, the first, second, third and fourth panels generally have a thickness T.

In yet another implementation, the first spacer panel generally has a width T.

In another implementation, the second spacer panel generally has a width 2 times T.

In another implementation, the third spacer panel generally has a width 3 times T.

In another implementation, the second and third spacer panels are generally parallel and the first spacer panel is generally perpendicular to the second and third spacer panels.

In another implementation, the second and third panels are side walls of the structure, the first panel is a rear wall of the structure and the fourth panel is a front wall of the structure.

In another aspect, the invention features a structure apparatus, including a roof deck, side walls connected to the roof deck, a front wall connected to the roof deck and to the side walls and a rear wall connected to the roof deck and the side walls.

In one implementation, the apparatus further includes a first elongated spacer panel connected between at least one of the side walls, the front wall and the rear wall, a second elongated spacer panel connected between at least one of the side walls, the front wall and the rear wall and a third elongated spacer panel between at least one of the side walls, the front wall and the rear wall.

In one implementation, the spacer panels are pivotally connected to the respective wall.

In another implementation, the first spacer panel is wider than the second spacer panel and the second spacer panel is wider than the third spacer panel.

In another implementation, the width of the first panel and respective wall is equal to the width of the second spacer panel and respective wall and further equal to the width of the third spacer panel and respective wall.

In another implementation, at least one of the side walls, the front wall and the rear wall is connected directly to the roof deck.

In still another aspect, the invention features a method of installing a modular structure, providing a folding modular structure having a top panel, side panels, a front panel and a rear panel, the panels facing upward, inverting the structure thereby allowing the panels to unfold, forming side walls, a front wall and a rear wall, lowering the structure onto a base, affixing the structure to the base, securing the panels to respective panels and adding hardware to the structure.

In one implementation, the methods further includes adding additional structures to the first structure.

In another implementation, the method further includes forming a detention center from a plurality of structures.

One advantage of the invention is that several more structures can be shipped to final destinations as compared to conventional structures.

Another advantage is that single structures can more easily be transported to remote and difficult to reach destinations.

Other objects, advantages and capabilities of the invention will become apparent from the following description taken in conjunction with the accompanying drawings showing the preferred embodiment of the invention.

DETAILED DESCRIPTION

Figure 1A:
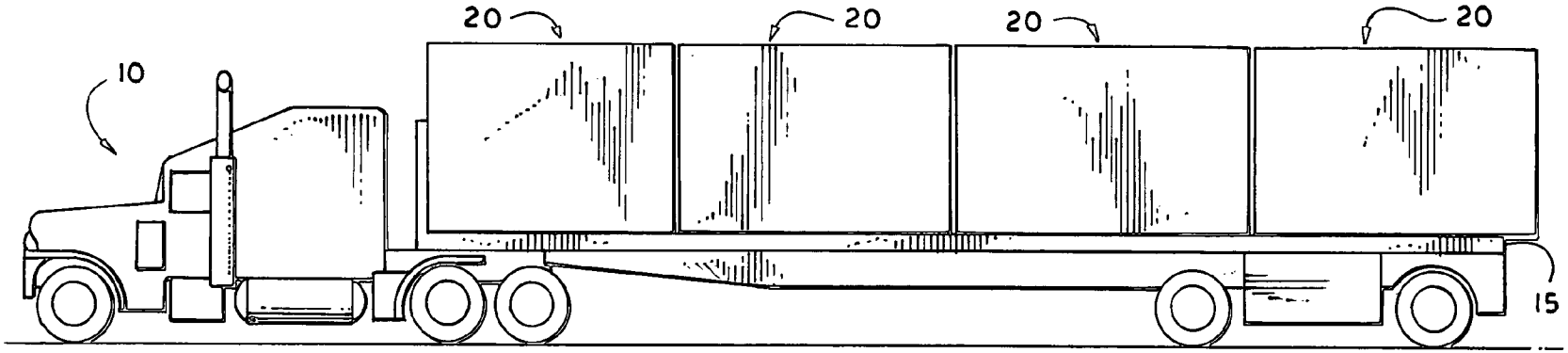
FIG. 1A PRIOR ART
FIG. 1A illustrates a prior art flat bed transport truck having prior art modular structures.
Figure 1B:
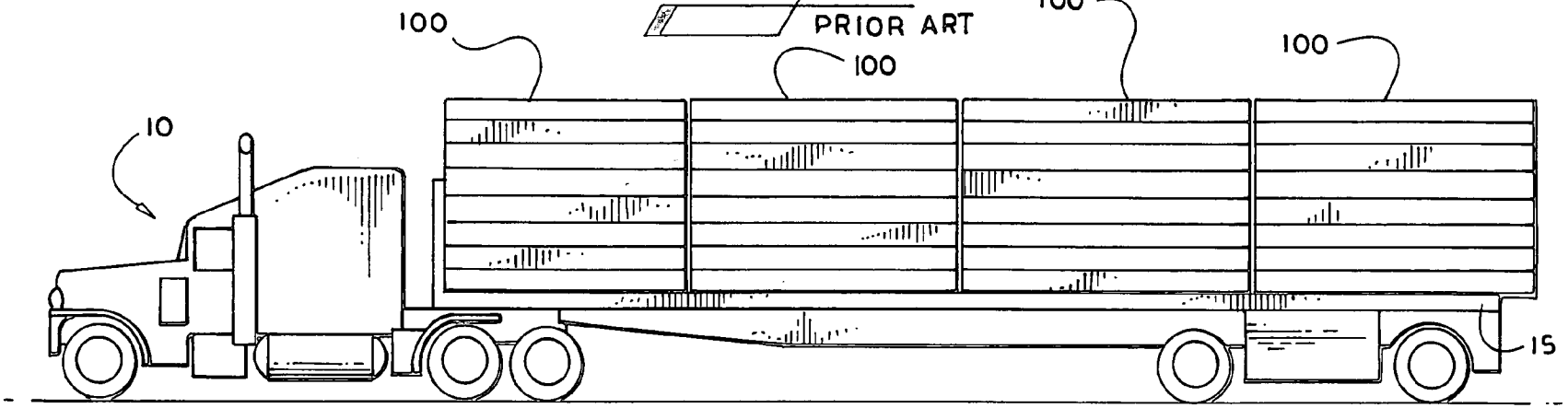
FIG. 1B illustrates a flat bed transport truck having embodiments of a folding modular structure.

Referring to the drawings wherein like reference numerals designate corresponding parts throughout the several figures, reference is made first to FIG. 1B illustrates a flat bed transport truck having embodiments of a folding modular structure 100. As is further appreciated in the description below, up to 32 of the embodiments of folding modular structures 100 can be placed on the trailer 15 of a flatbed truck 10. The structures 100 are typically loaded onto the trailer 15 upside down so that the folding panels (see below) do not prematurely unfold. When the structures 100 are ready for placement, they are inverted so that the force of gravity is allowed to unfold the panels.

Figures 1C, 2, 3:
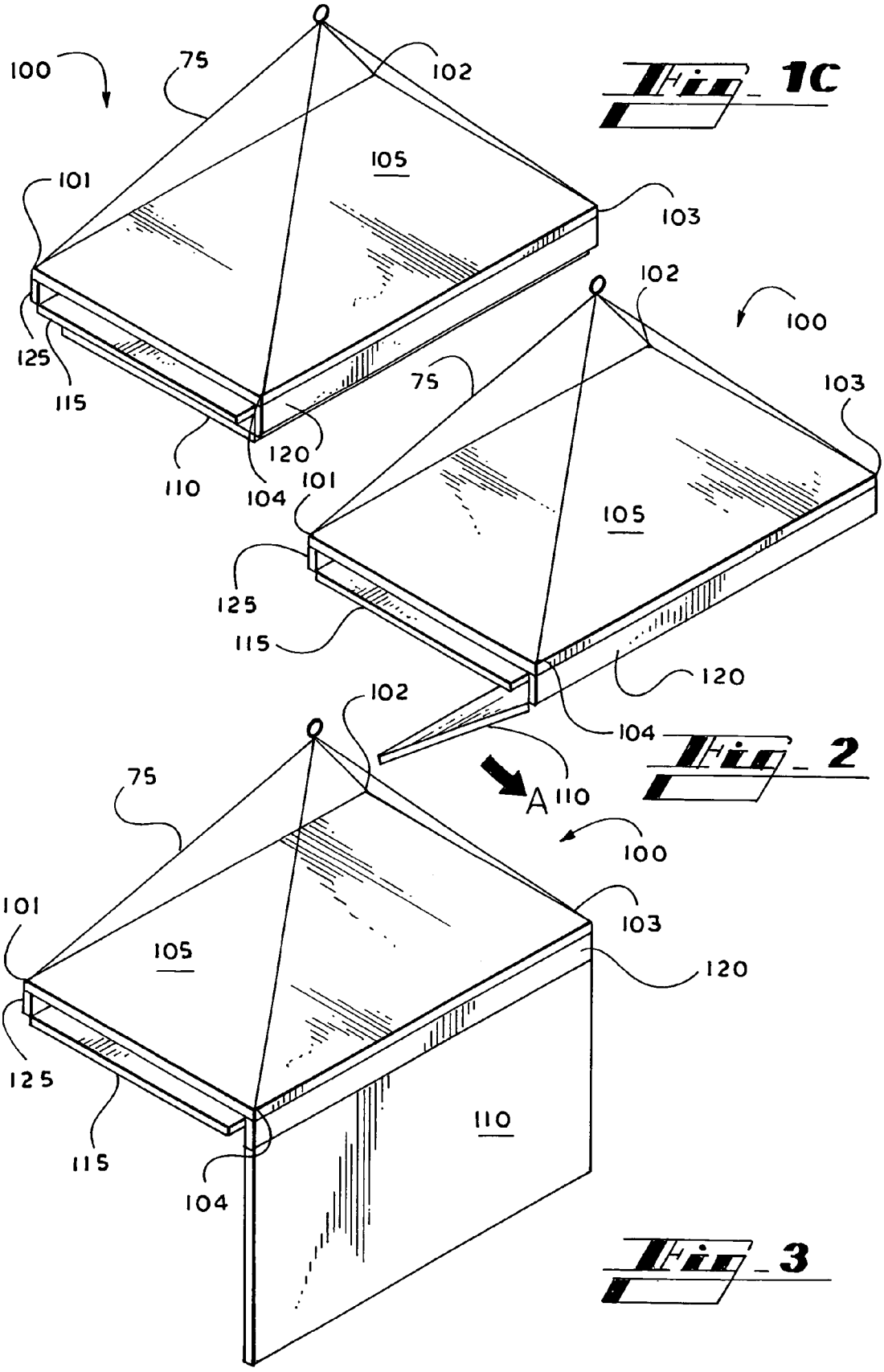
FIG. 1C illustrates a perspective side view of an embodiment of a folding modular structure in a first position.
FIG. 2 illustrates a perspective side view of an embodiment of a folding modular structure in a second position.
FIG. 3 illustrates a perspective side view of an embodiment of a folding modular structure in a third position.

In FIG. 1C and the several figures that follow, the cell 100 has been inverted so that it can unfold into a fully open position as is now described. Typically, a crane, large forklift or other suitable lifting mechanism can lift and invert the structure 110 into the inverted position to allow the panels to unfold into the open position. Typically, cables or other suitable rigging 75 can be connected to the four corners 101, 102, 103, 104 of the structure 100 in order to lift, invert and unfold the panels of the structure 100.

FIG. 1C illustrates a perspective side view of an embodiment of a folding modular structure 100 in a first position. The structure 100 generally includes a top panel 105 that is ultimately the roof of the structure 100. The structure 100 further includes side panels 110, 115 that are shown in a "folded-under" position. Each side panel 110, 115 is connected to a respective elongated side spacer panel 120, 125 that are connected generally perpendicular to respective sides of the top panel 105. As is further illustrated and described below with respect to FIG. 13, the side panels 110, 115 are pivotally connected to the respective side spacer panel 120, 125. In this folded first position, the side panels 110, 115 are generally parallel to the top panel 105 and generally perpendicular to the side spacer panels 120, 125. Furthermore, there are certain dimensional relationships among the side panels 110, 115 and the side spacer panels 120, 125 that enables the structure 100 to be folded onto itself.

FIG. 2 illustrates a perspective side view of an embodiment of a folding modular structure 100 in a second position. In this second position the first side panel 110 is unfolding in the direction of arrow A into its open position. Typically, the side panel 110 impinges the motion of the side panel 115 (and the front and rear panels as described with respect to FIGS. 6–7). However, once the side panel 110 unfolds, the side panel 115 typically also begins to unfold.

FIG. 3 illustrates a perspective side view of an embodiment of a folding modular structure 100 in a third position. In this third position, the side panel 110 is fully open and generally adjacent and oriented parallel (and co-planar) to the side spacer panel 120 and perpendicular to the top panel 105. Typically the panel 110 is still free to rotate slightly with respect the side spacer panel 120. However, gravity keeps the side panel 110 fully unfolded.

Figure 4:
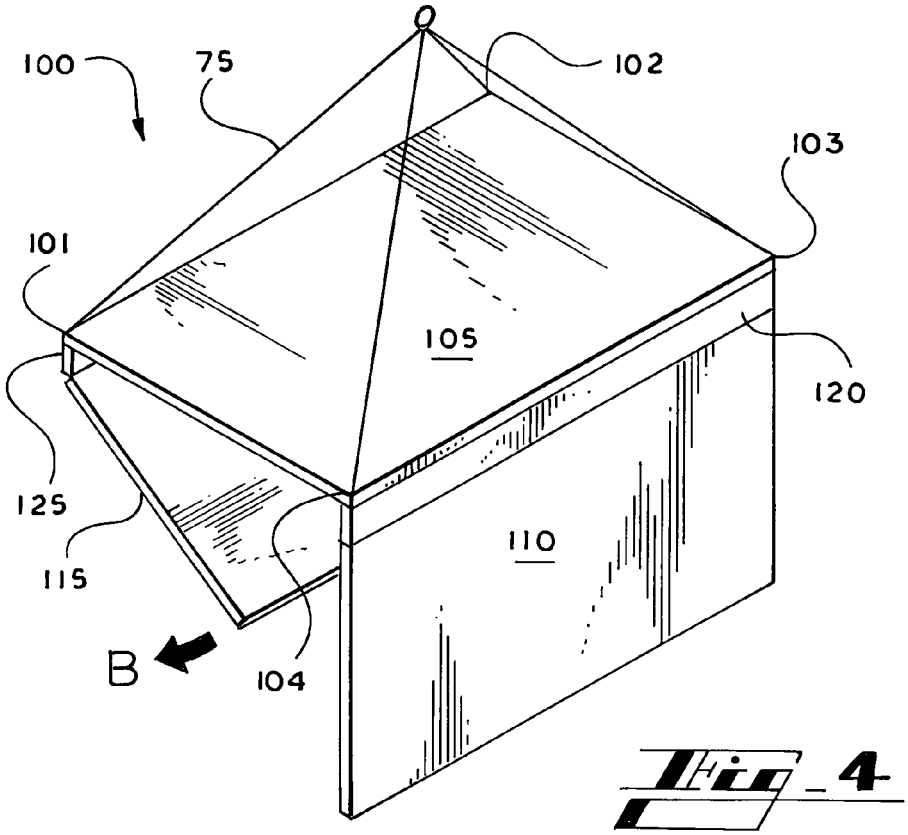
FIG. 4 illustrates a perspective side view of an embodiment of a folding modular structure in a fourth position.

FIG. 4 illustrates a perspective side view of an embodiment of a folding modular structure 100 in a fourth position. In this fourth position the second side panel 115 is unfolding in the direction of arrow B into its open position. Typically, the side panel 110 impinges the motion of the front and rear panels (see FIGS. 6–7 below). However, once the side panel 110 unfolds, the other panels typically also begin to unfold.

Figure 5:
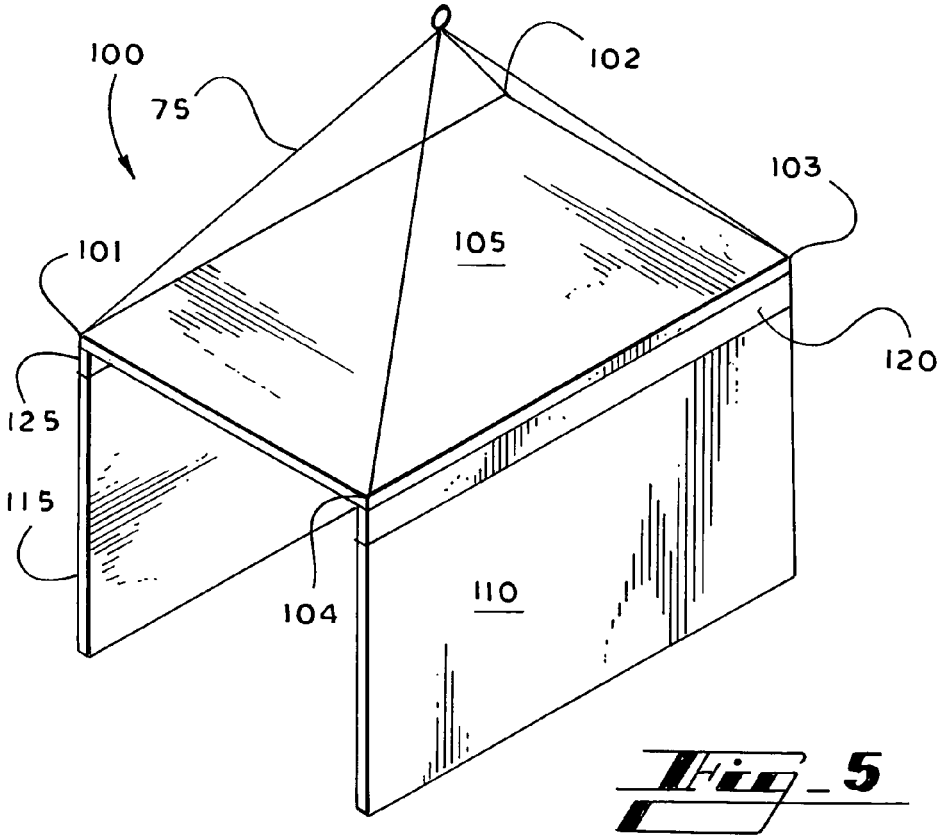
FIG. 5 illustrates a perspective side view of an embodiment of a folding modular structure in a fifth position.

FIG. 5 illustrates a perspective side view of an embodiment of a folding modular structure 100 in a fifth position. In this fifth position, the side panel 115 is fully open and generally adjacent and oriented parallel (and co-planar) to the side spacer panel 125 and perpendicular to the top panel 105. Furthermore, the side panels 110, 115 are generally parallel to each other and are ultimately the side walls of the structure 100. Typically the panel 115 is still free to rotate slightly with respect the side spacer panel 125. However, gravity keeps the side panel 115 fully unfolded.

Figure 6:
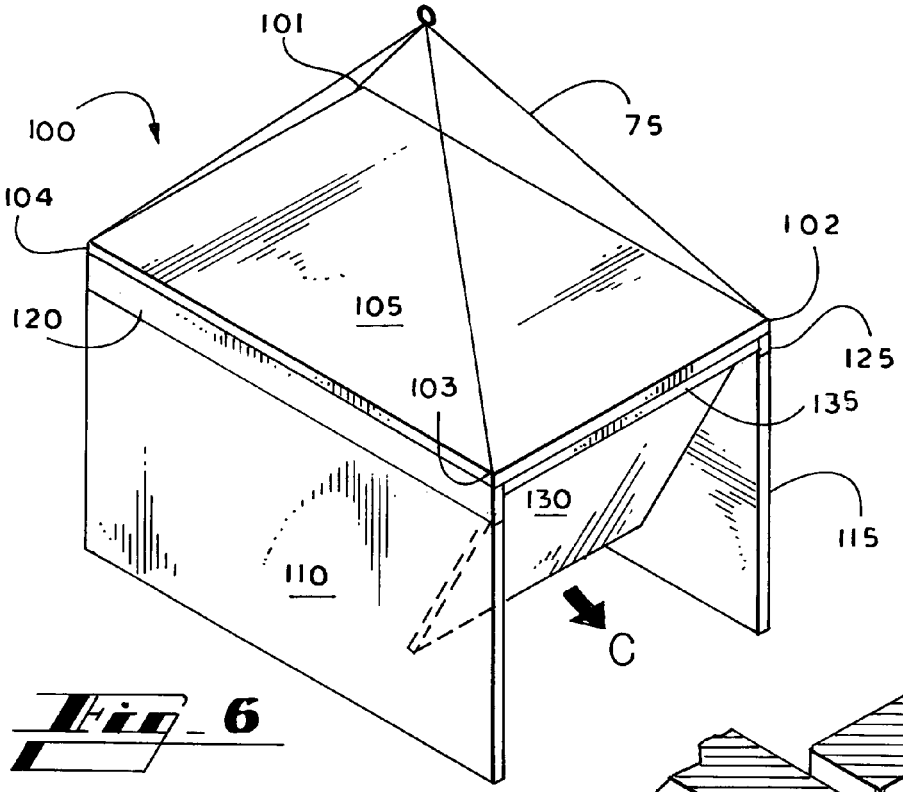
FIG. 6 illustrates a perspective rear view of an embodiment of a folding modular structure in a sixth position.

FIG. 6 illustrates a perspective rear view of an embodiment of a folding modular structure 100 in a sixth position. In this sixth position the rear panel 130 is unfolding in the direction of arrow C into its open position. It is now illustrated that the rear panel 130 is pivotally connected to a rear spacer panel 135 similar to how the side panels 110, 115 are respectively connected to the side spacer panels 120, 125. Typically, the rear panel 130 continues to impinge the motion of the front panel (see FIG. 7 below). However, once the rear panel 130 unfolds, the front panel typically also begins to unfold. Although a separate figure is not used to illustrate the rear panel 130 fully unfolded, once the rear panel 130 unfolds, it is in its fully open position and generally adjacent and oriented parallel (and co-planar) to the rear spacer panel 135 and perpendicular to the top panel 105. Furthermore, the rear panel 130 is generally perpendicular to the side panels 110, 115 and is ultimately the rear wall of the structure 100. Typically the rear panel 130 is still free to rotate slightly with respect the side spacer panel 135. However, gravity keeps the rear panel 130 fully unfolded.

Figure 7:
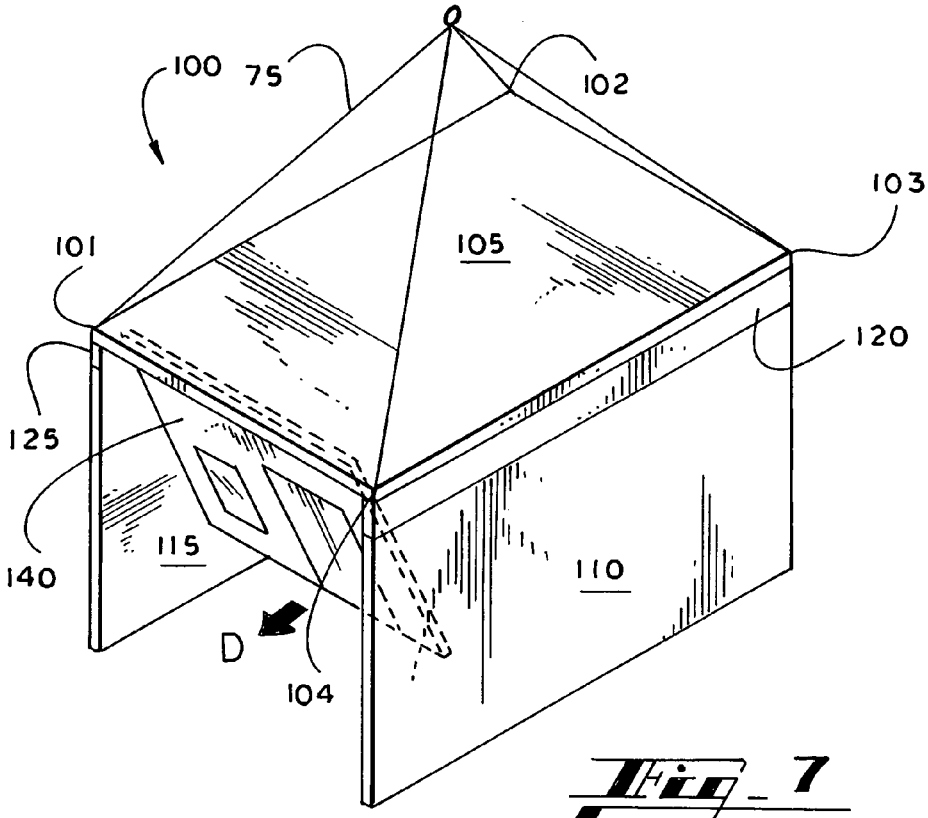
FIG. 7 illustrates a perspective front view of an embodiment of a folding modular structure in a seventh position.

FIG. 7 illustrates a perspective front view of an embodiment of a folding modular structure 100 in a seventh position. In this seventh position the front panel 140 is unfolding in the direction of arrow D into its open position. It is now illustrated that the front panel 140 is pivotally connected directly to the front end of the top panel 105, unlike the rear panel 130 and side panels 110, 115 that are all respectively connected to a spacer panel 120, 125, 135. Typically, the front panel 140 is the last panel to unfold and therefore impinges no motion of any other panel. Although a separate figure is not used to illustrate the front panel 140 fully unfolded, once the front panel 140 unfolds, it is in its fully open position and generally perpendicular to the top panel 105. Furthermore, the front panel 140 is generally perpendicular to the side panels 110, 15, and generally parallel to the rear panel 130 and is ultimately the front wall of the structure 100. Typically, as with the other panels 110, 15, 130, the front panel 140 is still free to rotate slightly with respect the top panel 105. However, gravity keeps the front panel 140 fully unfolded.

The figures above describe the basic motion of the panels as they unfold until the structure 100 is in a fully open position. It is appreciated that once the folded structure is removed from the flatbed truck and inverted as described above, it is the force of gravity that exerts the necessary torques on the panels so that they rotate with respect to the top panel to be unfolded. The above described figures illustrate that each panel unfolds while the other panels stay stationary. These figures are shown in this manner for illustrative purposes. It is understood that the force of gravity is exerted on all the panels simultaneously and that they may unfold and slide passed each other in a variety of ways.

Figure 8:
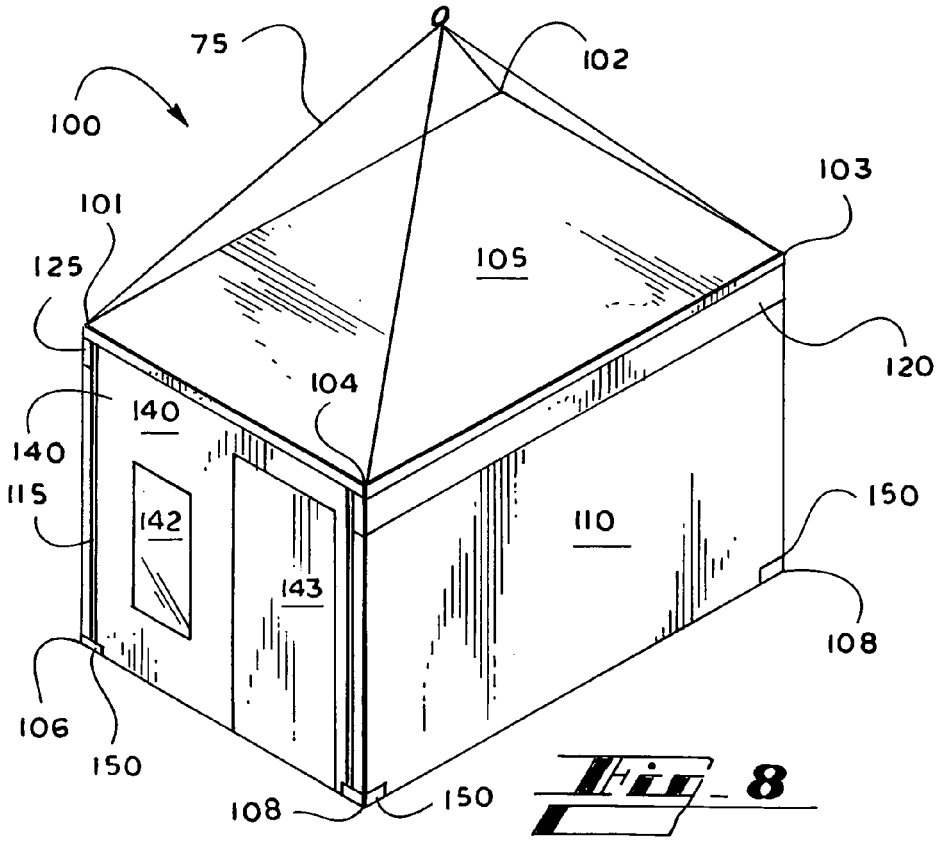
FIG. 8 illustrates a perspective front view of an embodiment of a folding modular structure in an eighth and final open position.

FIG. 8 illustrates a perspective front view of an embodiment of a folding modular structure 100 in an eighth and final open position. In this view, the structure 100 is still supported by the rigging 75. Furthermore, as described above, the structure 100 typically is placed on a slab or other base and must be properly plumbed, squared and otherwise secured. In order to secure the panels 110, 115, 130, 140 with respect to each other suitable brackets 150 are secured on the lower four corners 106, 107, 108, 109 of the structure 100. Furthermore, each of the panels 110, 115, 130, 140 may be fitted with hardware or other dressing such as a window 142 and a door 143 as shown on front panel 140.

Figure 9:
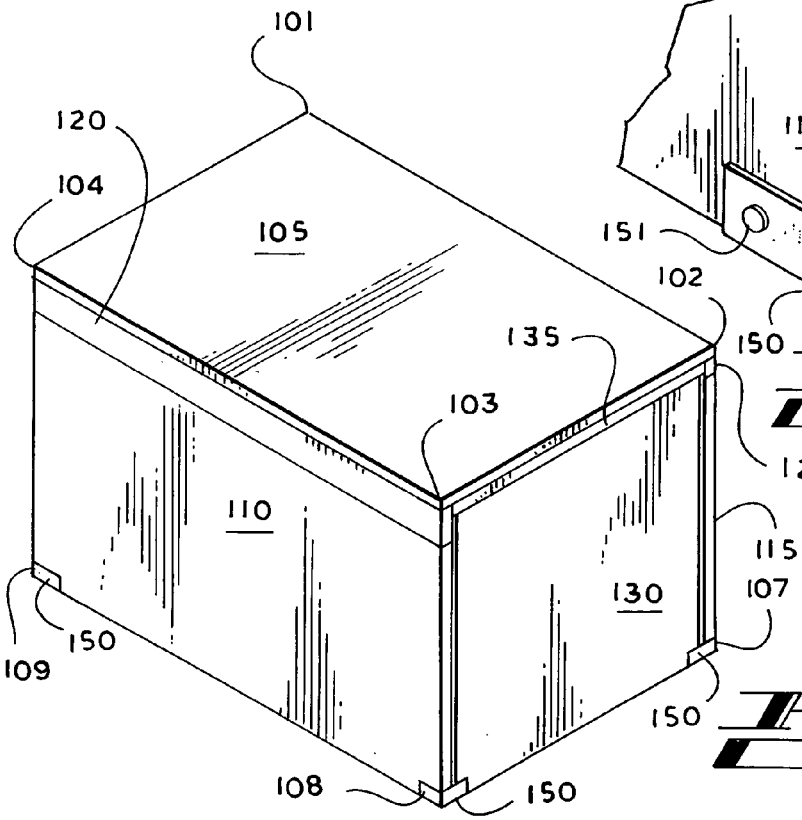
FIG. 9 illustrates a perspective view rear view of an embodiment of a folding modular structure in an open position.

FIG. 9 illustrates a perspective view rear view of an embodiment of a folding modular structure 100 in an open position. In this view, the structure 100 no longer supported by the rigging 75. This rear view shows the brackets 150 on the four corners 106, 107, 108, 109 of the structure 100.

Figure 10:
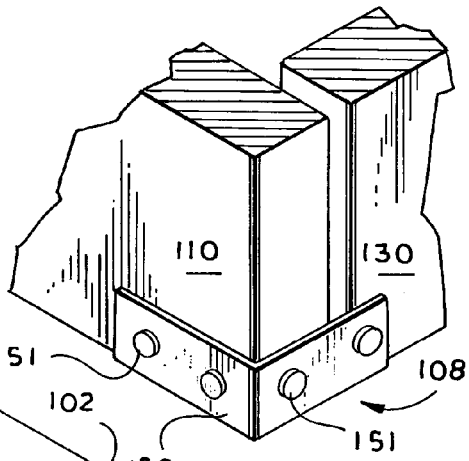
FIG. 10 illustrates a close up view of a lower corner of an embodiment of a folding modular structure.

FIG. 10 illustrates a close up view of a lower corner 108 of an embodiment of a folding modular structure 100. This view illustrates the lower corner 108 for illustrative purposes. It is understood that the other lower corners 106, 107, 109 are similarly oriented. The bracket 150 is shown securing the rear panel 130 and the side panel 110. Suitable connecting devices 151 such as bolts are used to secure the bracket 150 to the panels 110, 130.

The following figures illustrate several dimensional and spatial orientations of the embodiment of the structure 100 as described above.

Figure 11:
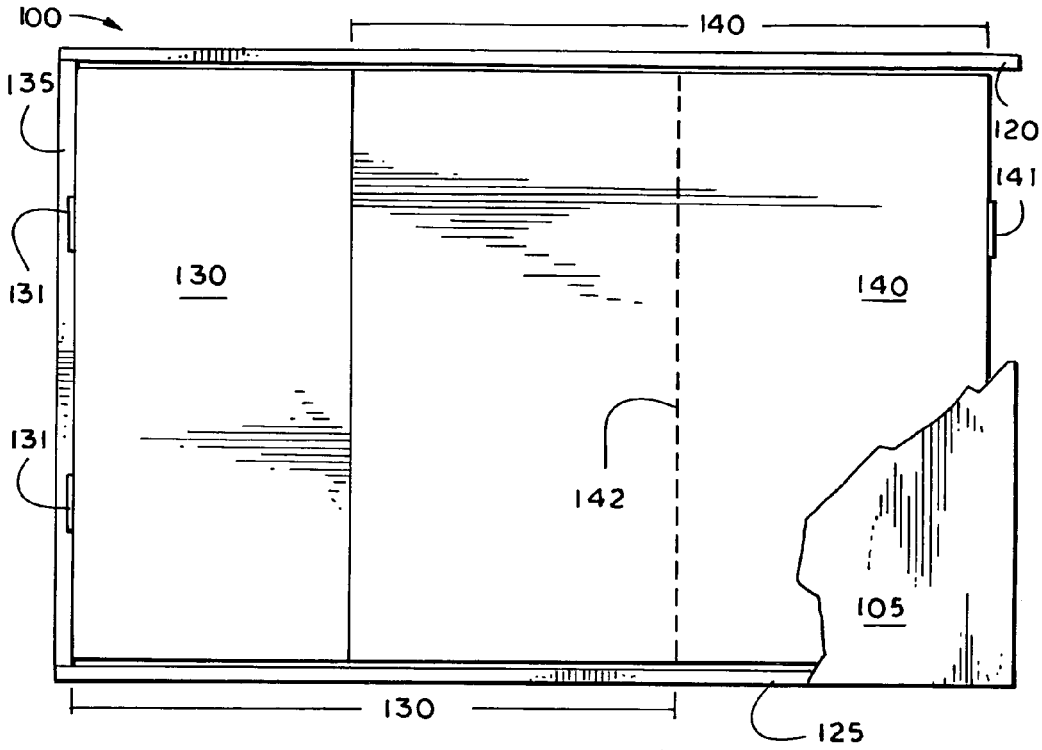
FIG. 11 illustrates a partial cut-away top view of an embodiment of a folding modular structure.

FIG. 11 illustrates a partial cut-away top view of an embodiment of a folding modular structure 100. The top panel 105 is only partially shown in order to illustrate the overlapping relationship of the front and fear panels 140, 130 when the structure 100 is in the folded position. The dotted line 142 illustrates that the forward edge of the rear panel 130 is folded underneath the front panel 140. As is now illustrated the front panel 140 is pivotally connected to the top panel 105 by a suitable pivoting device 141 such as a hinge or roller. Similarly, the rear panel 130 is pivotally connected to the rear spacer panel 135 by a suitable pivoting device 131 such as a hinge or roller. The side spacer panels 126, 125 are also shown.

Figure 12:
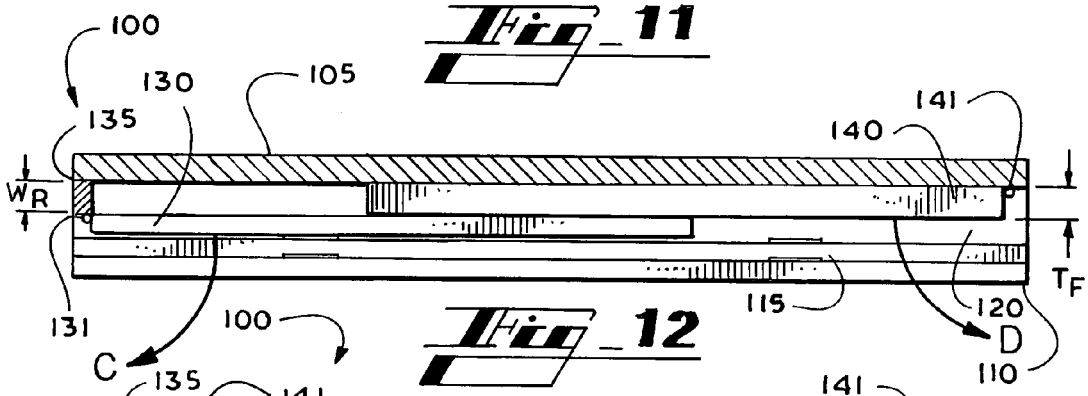
FIG. 12 illustrates a partial cut-away side view of an embodiment of a folding modular structure.

FIG. 12 illustrates a partial cut-away side view of an embodiment of a folding modular structure 100. As described above, the front panel 140 is pivotally connected to the forward end of the top panel 105 by pivoting device 141. The front panel 140 is shown in the fully folded position. The rear panel 130 is pivotally connected to the rear spacer panel 135 by connecting device 131. The rear spacer panel 135 is connected generally perpendicular to the rear end of the top panel 105. The rear panel 130 is also shown in its fully folded position. Since the front panel 140 is connected directly to the top panel 105, when it is in its fully folded position, it lays generally flush to the interior of the top panel 105. This flush orientation is desirable in order to minimize the space that the structure 100 uses when in transport. In fact, this type of flush orientation is desirable for all of the remaining panels 110, 115, 130. As such, since the rear panel 130 is the next panel that is folded, the rear spacer panel 135 provides a spacing from the top panel 105 to the connection device 131 that is generally equal to the thickness of the front panel 140. As such, the width $W_{Rear}$ of the rear spacer panel 135 is generally equal to the thickness $T_{Front}$ of the front panel 140. It is appreciated that if $W_{Rear}$ is less than $T_{Front}$, then the rear panel 130 would not lie flush on the front panel 140. Similarly, if $W_{Rear}$, is greater than $T_{Front}$, then the rear panel 130 would also not lie flush on the front panel 140. It is further understood that small variances between $W_{Rear}$ and $T_{Front}$ can be expected in actual practice.

Arrows C, D are shown as are illustrated in FIGS. 6 and 7 above. The side panels 110, 115 are also shown in FIG. 12. The side spacer panel 120 is further illustrated. The dimensional relationship and spatial orientations of the side panels 110, 115 with respect to the front and rear panels 140, 130 as well as the entire structure 100 are now described.

Figure 13:
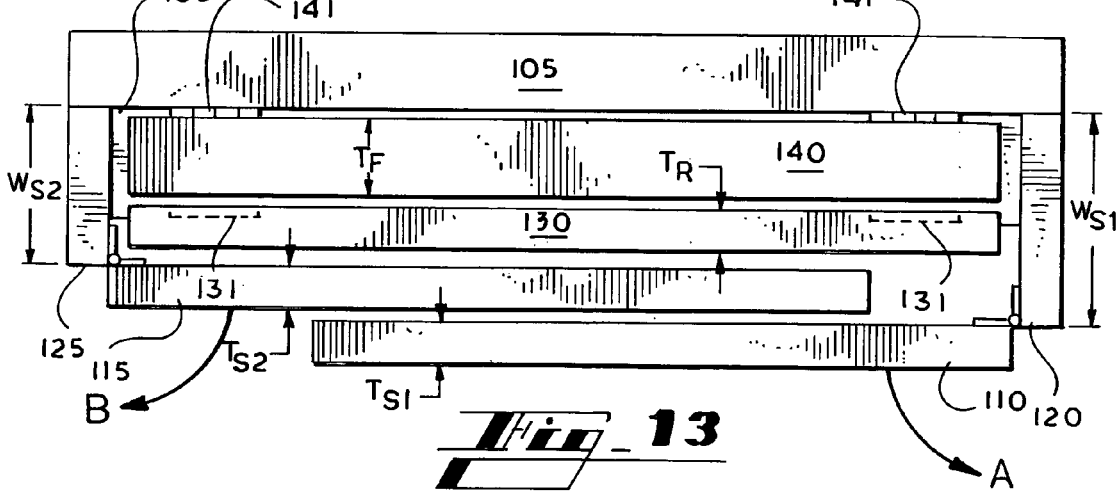
FIG. 13 illustrates a front view of an embodiment of a folding modular structure.

FIG. 13 illustrates a front view of an embodiment of a folding modular structure 100. The structure 100 is illustrated in its fully folded position. The front panel 140 is pivotally connected to the top panel 105 by pivoting devices 141. The rear spacer panel 135 is connected generally perpendicular to the top panel 105 and the rear panel 130 is pivotally connected to the rear spacer panel 135 by pivoting device 131 as described above. Also as described above, it is desirable that all remaining side panels 110, 115 also lie flush upon one another and the front and rear panels 140, 130. As such, the side spacer panels 120, 125, which are connected generally perpendicular to the top panel 105, also have certain dimensional and spatial relationships.

The side spacer panel 120 generally has the greatest width of all of the spacer panels described herein. In general, in order for the remaining panels to lie flush, the width $W_{Side1}$ of the side panel 120 is generally equal to the thickness of the front panel $T_{Front}$ plus the thickness of the rear panel $T_{Rear}$ plus the thickness of the side panel 125 $T_{Side2}$. Furthermore, the width $W_{Side2}$ of the side spacer panel 125 is generally equal to the thickness of the front panel $T_{Front}$ plus the thickness of the rear panel $T_{Rear}$. As a general rule, in order for the panels to fit flush, each spacer panel connected to the panel being currently folded generally has a width equal to the sum of the thicknesses of the panels already folded under. As such, it is appreciated that the front panel 140 has no spacer panel since there are no panels folded underneath. Similarly, the remaining spacer panels have widths equal to the sum of the thicknesses of the folded panels as described in detail above. It is also appreciated that the longest panel from the base onto which the structure 100 stands to the top panel 105 is the front panel 140. The next longest panel is the rear panel 130 that is shorter than the front panel 140 by the width $W_{Rear}$ of the rear spacer panel 135. The next longest panel is the side panel 115 that is shorter than the front panel 140 by the width $W_{Side2}$ of the side spacer panel 125. The shortest panel is the side panel 120 which is shorter than the front panel 140 by the width $W_{Side1}$ of the side spacer panel 120. It is also appreciated that the overall widths of the panels can be described relative to one another and not just the front panel 140.

It is appreciated that the structure 100 may have panels of varying thicknesses. If the structure 100 included panels all having the same thickness T, then the general rule could be that the rear spacer panel 135 has width equal to T, the side spacer panel has width equal to 2T and the side spacer panel 120 has the width 3T. Once again, it is understood that there are variances in the widths and thicknesses that may vary the general rules. Furthermore, it may be desired to leave small spaces between the panels therefore requiring that the widths of the spacer panels may be larger than described above.

It is further appreciated that a certain order of folding and unfolding has been described above. It is understood that other folding and unfolding orders are contemplated. For example, the rear panel 130 may not include a spacer panel and the front panel may include a spacer panel so that the front panel 140 folds out first and the rear panel 130 folds out last. The same may be true for the side panels 110, 115. The side panel 110 may not include a spacer panel so that it folds out last. As such the side panel 115 and the front and rear panels 140, 130 would include increasingly wide spacer panels as described above for the side panels 110, 115. Therefore, it is understood that there can be many variances in the widths of the spacer panels and the folding orders of the panels so long as the general rule that the spacer panel is generally as wide as the panels that have already been folded in order to keep the panels generally flush with one another.

The embodiments described above have discussed the general structure 100 that is foldable for easy transport and deployment. This structure 100 can have a variety of uses where structures are required. For example, several remote structures are often required for meteorological and cellular tower stations, which can be difficult to deploy, due to remote locations and narrow access roads. By the structure 100 being foldable, the structure can more easily be transported to these remote locations. It is understood that there are a variety of other uses for the structure such as, but not limited to living quarters storage facilities and the like. Furthermore, the modular nature of the structure 100 allows several of the structures 100 to be interconnected and stacked, as needed, for uses to build homes or other dwellings.

In a typical implementation, the structures 100 can be set side by side and stacked in order to develop jail cells or other detention facilities. As such, the structures 100 must be sturdy and meet certain requirements as appreciated by those skilled in the art.

Figure 14:
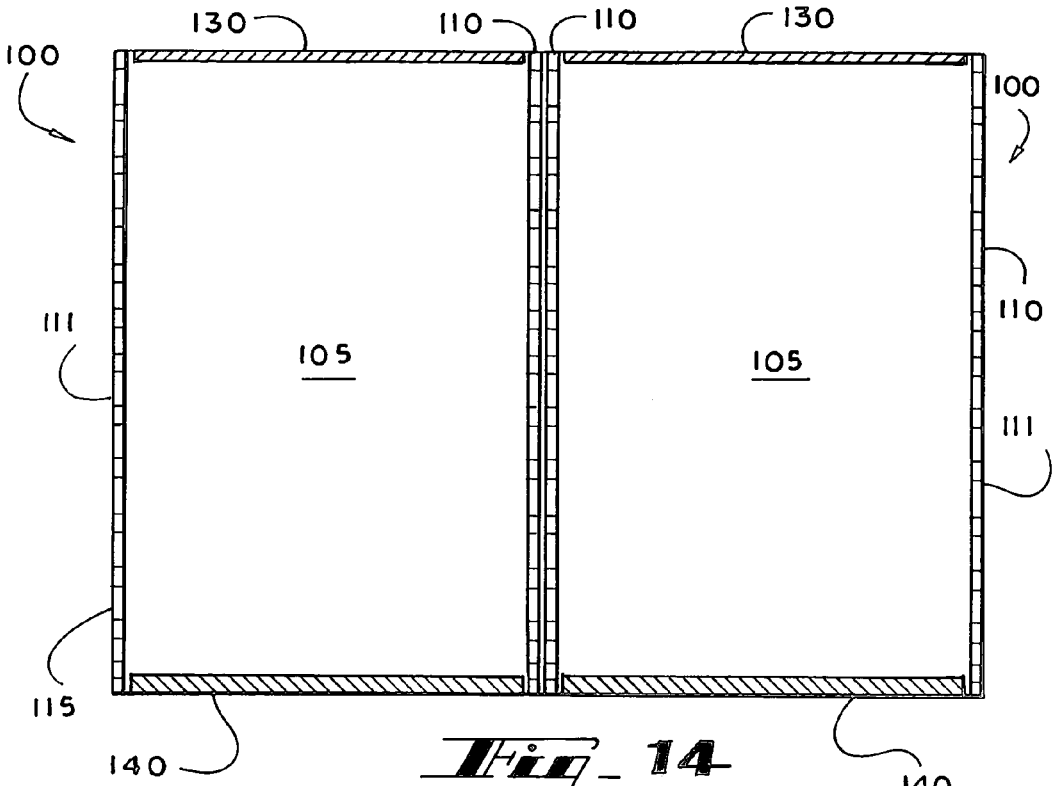
FIG. 14 illustrates a top view of two embodiments of a folding modular structure placed side by side.
Figure 15:
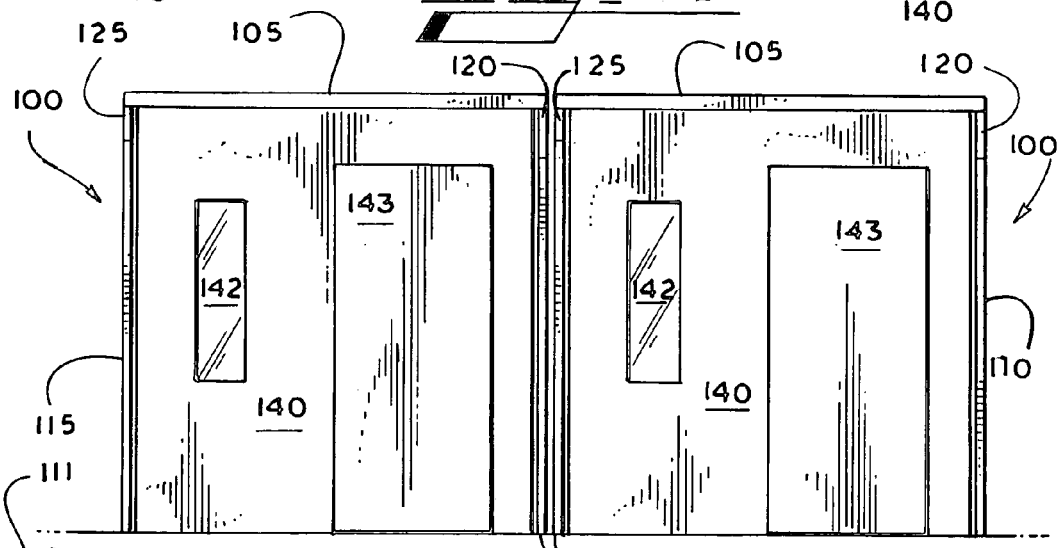
FIG. 15 illustrates a front view of two embodiments of a folding modular structure placed side by side.

FIG. 14 illustrates a top view of two-embodiments of a folding modular structure 100 placed side by side and FIG. 15 illustrates a front view of two embodiments of a folding modular structure 100 placed side by side. The partial cut away view in FIG. 14 illustrates that the structure 100 can include, among other things necessary for a detention cell, reinforcement beams 111 within the panels 110, 115. Other reinforcement beams can also be located in the front and rear panels 140, 130. The structure 100 can also include a window 142 and door 143, which can be pre-installed on the panels as needed. Other furnishings such as plumbing, lighting and other electrical hook ups are installed.

As described above, to erect the structure 100, the folded structure 100 is lifted vertically upward, inverted, and allowing the panels to unfold at their pivoting locations. As the top panel 105 is raised. Once the panels are unfolded to the vertical position, the structure 100 is placed in "jig" on the floor slab, adjusted for square and plumb, then the specially designed brackets 150 (and other hardware) are fastened in place to render the entire structure 100 rigid and structurally stable. Interior trim hardware is then installed around the inner corners where the panels meet the top panel in order to permanently conceal the pivoting devices and other folding mechanisms, and to provide additional structural stability. For a typical detention center cell, certain security grade features are also installed as well as having bullet resistance hardware. Any final painting, inspection and the like can be later performed.

Figure 16:
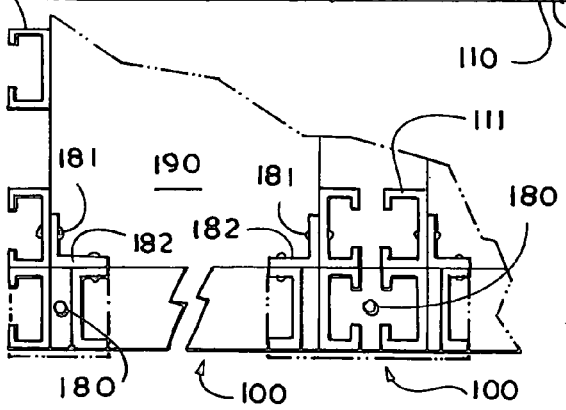
FIG. 16 illustrates a partial cut-away top view of interconnection hardware.

FIG. 16 illustrates a partial cut-away top view of interconnection hardware. As described above, the structures 100 can be laid side by side on a slab 190. This view shows tow of the structures 100 side by side illustrating the inner reinforcement beams 111. As described above, outer brackets 150 can be secured on the lower corners 106, 107, 108, 109 of the structures 100 in order to secure the panels 110, 115, 130, 140 from pivoting. Inner brackets 182 and bolts 181 can also be secured to the structures in order to keep the panels 110, 115, 130, 140 from pivoting as well as securing the structures 100 to each other. Retaining bolts 180 can be used to connect the overall structures 100 to the slab 190. It is understood that there are many variations that can be used to secure the structures 100.

By way of example, in the specific implementation of a jail cell, when in the fully folded position, the structure 100 can become a unit that is "Cell Width" wide×"Cell Length" long approximately 4×"Cell Wall Thickness"+"Cell Roof-Deck Thickness" high. In a more specific example, a cell that is approximately 8'0" wide×12'0" long×8'0" high can be folded into a unit that is 8'0" wide×12'0" long by 1'0" high (4×2" wall thickness+4" roof deck thickness).

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A modular structure, comprising:

a top panel having four sides;

a first spacer panel connected generally perpendicular to a first side of the top panel;

a first panel pivotally connected to the first spacer panel;

a second spacer panel connected generally perpendicular to a second side of the top panel;

a second panel pivotally connected to the second spacer panel;

a third spacer panel connected generally perpendicular to a third side of the top panel;

a third panel pivotally connected to the third spacer panel; and a fourth panel pivotally connected to a fourth side of the top panel, wherein the first, second, third and fourth panels generally have a thickness T, the first spacer panel generally has a width T, the second spacer panel generally has a width 2 times T and the third spacer panel generally has a width 3 times T.

2. The structure as claimed in claim 1 wherein the first spacer panel and the first panel are coplanar, the second spacer panel and second panel are coplanar and the third spacer panel and the third panel are coplanar.

3. The structure as claimed in claim 1 wherein two of the first, second, third and fourth panels are side walls of the structure, one of the first, second, third and fourth panels is the front wall of the structure and one of the first, second, third and fourth panels is the rear wall of the structure.

4. The structure as claimed in claim 1 wherein the second and third spacer panels are generally parallel and the first spacer panel is generally perpendicular to the second and third spacer panels.

5. The structure as claimed in claim 4 wherein the second and third panels are side walls of the structure, the first panel is a rear wall of the structure and the fourth panel is a front wall of the structure.

6. A structure apparatus, comprising:

a roof deck;

side walls connected to the roof deck;

a front wall connected to the roof deck and to the side walls;

a rear wall connected to the roof deck and the side walls;

a first elongated spacer panel connected between at least one of the side walls, the front wall and the rear wall;

a second elongated spacer panel connected between at least one of the side walls, the front wall and the rear wall; and a third elongated spacer panel between at least one of the side walls, the front wall and the rear wall, wherein the first spacer panel is wider than the second spacer panel and the second spacer panel is wider than the third spacer panel, wherein the width of the first panel and respective wall is equal to the width of the second spacer panel and respective wall and further equal to the width of the third spacer panel and respective wall.

7. The apparatus as claimed in claim 6 wherein the spacer panels are pivotally connected to the respective wall.

* * * * *